US011624279B2

(12) United States Patent
Hudson et al.

(10) Patent No.: US 11,624,279 B2
(45) Date of Patent: Apr. 11, 2023

(54) REVERSE DRILL STEM TESTING

(71) Applicant: Halliburton Energy Services, Inc., Houston, TX (US)

(72) Inventors: Marcus Ray Hudson, Pearland, TX (US); Pramod Chamarthy, Frisco, TX (US); Michel Joseph LeBlanc, Houston, TX (US); Christopher Michael Jones, Katy, TX (US); Darren George Gascooke, Houston, TX (US); Anthony Herman van Zuilekom, Houston, TX (US); Jay Paul Deville, Spring, TX (US); William W. Shumway, Spring, TX (US); Dale E. Jamison, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/447,662

(22) Filed: Sep. 14, 2021

(65) Prior Publication Data

US 2022/0243588 A1 Aug. 4, 2022

Related U.S. Application Data

(60) Provisional application No. 63/145,778, filed on Feb. 4, 2021.

(51) Int. Cl.
*E21B 49/00* (2006.01)
*E21B 49/08* (2006.01)

(52) U.S. Cl.
CPC ..... *E21B 49/008* (2013.01); *E21B 49/087* (2013.01)

(58) Field of Classification Search
CPC ..... E21B 49/008; E21B 49/087
See application file for complete search history.

(56) References Cited

U.S. PATENT DOCUMENTS 6,790,812 B2 * 9/2004 Halliday ..... C09K 8/16 507/140
8,087,292 B2 1/2012 Voelker
(Continued)

FOREIGN PATENT DOCUMENTS

CA 2643872 C * 8/2012 ..... C09K 8/72
WO 2005095757 A1 10/2005
(Continued)

OTHER PUBLICATIONS

Bruton et al. "Lost Circulation Control: Evolving Techniques and Strategies to Reduce Downhole Mud Losses" SPE/IADC 67735 (Year: 2001).*

(Continued)

*Primary Examiner* — John Fitzgerald
(74) *Attorney, Agent, or Firm* — Delizio, Peacock, Lewin & Guerra

(57) ABSTRACT

A method comprises flowing a mud into a wellbore, wherein the mud has a mud composition and has a weight in a defined range. The method includes introducing a fluid pill into the mud flowing into the wellbore, wherein the fluid pill has an injection fluid with an injection composition that is different from the mud composition. A particulate has been added to the injection fluid to increase the weight of the fluid pill. After flowing the mud into the wellbore such that the fluid pill is positioned in a zone of the wellbore: filtering out the particulate from the injection fluid; injecting, after the filtering, the injection fluid into the zone; measuring a downhole parameter that changes in response to injecting the injection fluid into the zone; and determining a property of the formation of the zone based on the measured downhole parameter.

20 Claims, 6 Drawing Sheets

(56) References Cited

U.S. PATENT DOCUMENTS

| | | | | |
|---|---|---|---|---|
| 8,286,703 | B2 | 10/2012 | Clapp et al. | |
| 8,528,394 | B2 | 9/2013 | Eriksen | |
| 8,550,160 | B2 | 10/2013 | Proett | |
| 8,763,694 | B2 | 7/2014 | Pipchuk et al. | |
| 8,794,318 | B2 | 8/2014 | Harrigan et al. | |
| 10,047,268 | B2 * | 8/2018 | Karale | C09K 8/725 |
| 10,144,861 | B2 * | 12/2018 | Lu | C09K 8/52 |
| 10,927,281 | B2 * | 2/2021 | Amanullah | C09K 8/035 |
| 10,927,282 | B2 * | 2/2021 | Amanullah | C09K 8/035 |
| 10,927,674 | B2 * | 2/2021 | Chen | C09K 8/508 |
| 2003/0195120 | A1 * | 10/2003 | Halliday | C09K 8/5045 507/140 |
| 2005/0113260 | A1 * | 5/2005 | Wood | C09K 8/508 507/117 |
| 2006/0191332 | A1 | 8/2006 | Manin et al. | |
| 2010/0242586 | A1 * | 9/2010 | Elshahawi | E21B 33/1243 73/152.39 |
| 2014/0238670 | A1 | 8/2014 | Pop et al. | |
| 2019/0218869 | A1 | 7/2019 | Amanullah | |
| 2020/0317980 | A1 * | 10/2020 | Amanullah | C09K 8/035 |
| 2020/0317982 | A1 * | 10/2020 | Amanullah | C09K 8/24 |
| 2021/0003003 | A1 | 1/2021 | Proett et al. | |
| 2021/0310352 | A1 * | 10/2021 | Pelletier | E21B 49/008 |
| 2021/0363883 | A1 * | 11/2021 | Jones | E21B 43/12 |

FOREIGN PATENT DOCUMENTS

| | | | |
|---|---|---|---|
| WO | 2005113937 | A2 | 12/2005 |
| WO | 2007134747 | A1 | 11/2007 |

OTHER PUBLICATIONS

Stair et al. "Planning and Execution of Highly Overbalanced Completions From a Floating Rig: The Ursa-Princess Wateflood Project " SPE Drilling & Completion SPE-134254 (Year: 2011).*

PCT Application No. PCT/US2021/071474, International Search Report, dated Dec. 7, 2021, 3 pages.

PCT Application No. PCT/US2021/071474, Written Opinion, dated Dec. 7, 2021, 4 pages.

* cited by examiner

REVERSE DRILL STEM TESTING

BACKGROUND

The disclosure generally relates to subsurface formation evaluation, and more particularly, to reverse drill stem testing for subsurface formation evaluation.

Once a borehole is drilled into the formation, formation evaluation is generally performed prior to completion of the well. Formation evaluation can include formation rock permeability, production capacity, fluid compositional properties, etc.

BRIEF DESCRIPTION OF THE DRAWINGS

Embodiments of the disclosure may be better understood by referencing the accompanying drawings.

FIG. 3 depicts a flowchart of example operations for reverse drill steam testing, according to some embodiments.

DESCRIPTION

Figure 1:
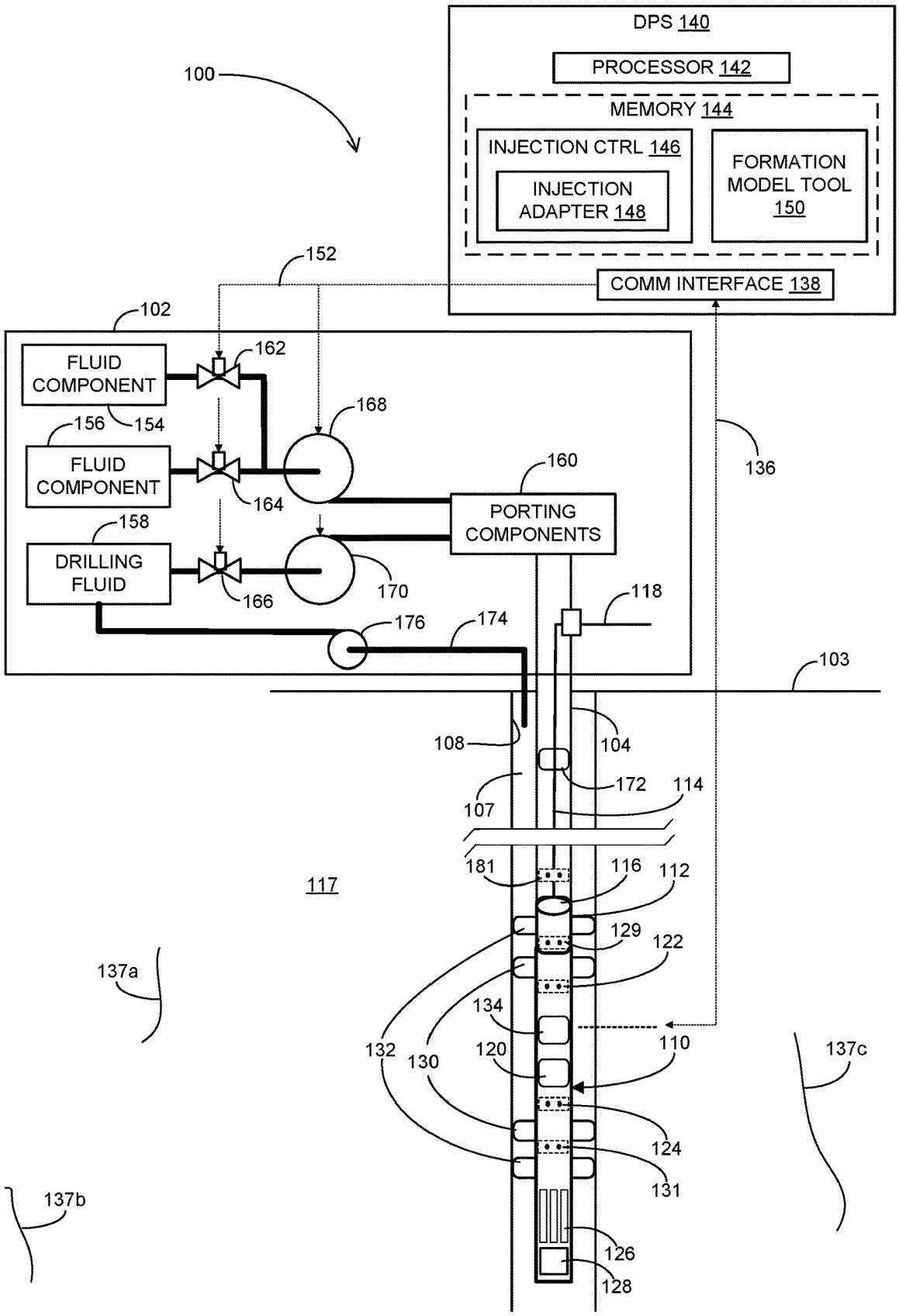
FIG. 1 depicts an example formation test system, according to some embodiments.

The description that follows includes example systems, methods, techniques, and program flows that embody aspects of the disclosure. However, it is understood that this disclosure may be practiced without these specific details. For instance, this disclosure refers to certain sizes of particles added to an injection fluid for needed weight in illustrative examples. Aspects of this disclosure can be also applied to other sizes not specifically listed. In other instances, well-known instruction instances, protocols, structures and techniques have not been shown in detail in order not to obfuscate the description.

A drill stem test (DST) is one approach for performing formation evaluation. DST can include deploying DST tools attached to a fluid conduit such a drill pipe within a bottom hole assembly (BHA) or a wireline. One or more packers can be deployed to substantially seal isolating test zones and isolated buffer zones that surround the isolated test zone. Also, DST tools can be configured to include downhole valves within the pressure isolated zone which could be opened and closed to simulate or prevent fluid flow in order to detect and record, pressures, pressure transients and flow rates as well as fluid properties. The dynamic pressure behavior and fluid properties information can be used to estimate the overall hydrocarbon extraction potential for a formation as well as determine optimal extraction means.

Example embodiments can incorporate a customized injection fluid that includes a particulate to provide weight to the fluid. This customized injection fluid can be a fluid pill that is added to the mud flowing in the wellbore as part of the wellbore operations. In some embodiments, particulate added to the customized injection fluid is such that the weight of the customized injection fluid is in a range that is the same or substantially similar to the range of weight of the mud. Such a weight range can be defined such that the weight of the mud and the customized injection fluid can prevent walls of the wellbore from collapsing and potentially preventing a blowout from the wellbore. For example, the fluid pill can include weighting agents such as barite and calcium carbonate. These agents may have a selected particle size range to aid in filtering them from the customized injection fluid. For example, the particles may be larger than 150 micron, 250 micron, etc. Also, the fluid pill can be water, brine, oil based or any other type of fluids (such as silicone oil, perfluoro oil, etc.). Example brines can include any combination of the following: sodium chloride (NaCl), calcium dichloride ($CaCl_2$), potassium chloride (KCl), sodium bromide (NaBr), calcium bromide ($CaBr_2$), potassium bromide (KBr), potassium formate, zinc bromide, etc. Example oil based fluids can include any combination of esters, mineral oils, aliphatic oils, olefins, diesel, naphthenic oils, synthetic oil, any oil typically used in drilling fluids, etc.

In some embodiments, the fluid pill can be pH controlled. The fluid pill may also contain one or more of the following: a viscosifying agent, a surfactant, a TURBULENT friction reducer, a clay inhibitor, a corrosion inhibitor, etc. In some embodiments, the fluid pill may have a volume of about 5 barrels (bbls), 10 bbls, 15 bbls, 20 bbls, etc. The volume may be selected to aid in pill placement and to minimize interface mixing of the fluid pill with the fluid leading and the fluid flowing the fluid pill so that a very clean and known fluid is being used for the injection test. In some embodiments, the customized injection fluid may contain a chemical component that may be used as a unique "tracer" to help distinguish the returned injection fluid from formation fluids. In some cases, the tracer concentration may provide an indication of any dilution of the returned injection fluid with the formation fluid. Also, the "tracer" component may be analyzed by spectrographic, electrical, optical or other means.

Additionally, flowing of the mud and the fluid pill into the wellbore can be controlled such that the fluid pill is positioned at a location where the customized injection fluid is to be injected into a zone of the subsurface formation that is being evaluated.

Also, the particulate added to the fluid pill can be composed of particles that can be easily filtered downhole in the wellbore prior to injection of the injection fluid into the subsurface formation. For example, a size of the particles can be at least 10 microns, at least 50 microns, at least 100 microns, etc. In some embodiments, the fluid pill can also be weighted with a non-particulate matter such as salts for a water-based injection fluid, or heavy miscible organic phase weighting agents for oil based injection such as but not limited to organometallic compounds.

Filtering the mud and using the mud for injection can be extremely difficult. Instead of mud, example embodiments include a fluid pill introduced into the mud. The fluid pill can include a customized injection fluid with a particulate added that provides added weight similar to the mud to stabilize the wellbore (preventing flow from and/or collapsing of the formation into the wellbore). The particulate can include particles that can be filtered out from the customized injection fluid prior to injection into a subsurface formation for formation evaluation and testing. Thus, the use of a customized injection fluid for injection into the formation can prevent damaging or altering of the formation (which can adversely affect the accuracy of the evaluation and testing).

Examples of such fluids to be used for injection can include brine, different types of oil-based fluids, etc. In some embodiments, suspension additives can be added to the fluid pill to reduce settling of the compositions in the fluid. Particles may include material that is magnetic, weakly magnetic, or be magnetizable (e.g., para or ferro magnetic). For example, the particles can include iron. Such particles can then be magnetically filtered. In some embodiments, the particles can settle. The particles can then be separated using a downhole centrifuge, hydrocyclone, etc.

Example embodiments can include multiple fluid pills. The multiple fluid pills can be for one zone or multiple zones of the formation to be tested. The multiple fluid pills for one zone can be adjacent to each other and/or separated by mud. In some embodiments with multiple fluid pills for one zone, each fluid pill can be a separate customized injection fluid with different properties. In such embodiments, a same zone can be tested with these different customized injection fluids to provide a more accurate evaluation of the zone. For example, each customized injection fluid could have a different viscosity, a different flow rate, etc. Alternatively or in addition for embodiments with multiple fluid pills for a same zone, one or more fluid pills can include a fluid to clean the flow path into the zone prior to the injection test. For example, a fluid pill can include a surfactant to clean the flow path for the injection fluid. A subsequent fluid pill having a customized injection fluid can then be positioned in this same zone to be injected into the formation for formation testing and evaluation. The injection fluid may be customized to maintain the initial formation rock wettability or alter the initial formation rock wettability. The injection fluid may be designed to be miscible or immiscible with the formation fluid.

Also, composition of the injection fluid is such that it is compatible with a continuous phase mud system. In some embodiments, the injection fluid can be weighted with non-particulate matter such as salts for a water based injection fluid.

Example embodiments use an injection tool for injection of the customized injection fluid into the formation. In some embodiments, the injection tool can be part of the drill pipe so that the drill pipe remains in the wellbore during testing. For example, the injection tool can be added to the end of the drill pipe and moved within the wellbore to the positions in the wellbore wherein injection tests are to be performed. Such embodiments allow for multiple zones at different depths to be tested. After the fluid pill(s) are positioned in the zone to be tested, the drill pipe can be moved so that the injection tool is positioned in the zone to perform the test(s).

In some embodiments, the injection tool can be positioned on a wireline. In these embodiments, the fluid pill(s) can be flowed to the correct depth for the zone using a drill pipe. The drill pipe can then be removed and a wireline can be lowered in the wellbore so that the attached injection tool is at the correct depth for this zone.

A formation testing string can be configured with enough length between an isolation packer zone and filters to be placed at the bottom of the formation testing string such that the anulus of the wellbore (excluding the volume of the formation tester portion below the packer) can contain enough volume for an injection test. Also, the formation testing packer section can include a hydraulic mud line from the top of the packer section to the lower portion of the packer section, with sufficient flow capability for the viscosity of the mud present in the wellbore as to balance the injection rate of the formation injection reverse test. The pass through can then attach to additional sections above and below the packer section as necessary. In some embodiments, the pass through would be as short as possible. For example, the pass through can be limited to the packer section itself. Upon setting the packer and subsequently performing a mini-injection test with sampling and subsequently initiating injection, the fluid can flow through the filters and be replaced by the mud on the top portion of the fluid pill to drive the injection pressure.

A downhole parameter that changes in response to injecting the injection fluid into the zone can be measured. For example, a fall off test can be performed by measuring a pressure of the zone as it changes over time. The injection fluid can be at or near the hydrostatic pressure while the formation is at some lower pressure. After the injection fluid flows into the formation and shut in, the pressure of the formation may be at or near the hydrostatic pressure. However, over time the pressure will return back to the formation pressure prior to the injection. This fall off of the pressure can then be used to determine a property of the formation.

Accordingly, example embodiments provide a reverse injection test such that injection fluid can be injected into the formation and the rate of decay of pressure can be measured to obtain formation characteristics. Such embodiments alleviate the environmental and safety concerns of conventional drill stem testing.

Alternatively or in addition to filtering the particles, filtration of the particles can include separation via magnetism, chemistry in which chemicals react with specific chemicals, etc.

Example Formation Test System

FIG. 1 depicts an example formation test system, according to some embodiments. A formation test system 100 includes subsystems, devices, and components configured to implement a two-stage fluid flow and testing procedure within a wellbore 107 that in the depicted embodiments is an uncased, open borehole. The formation test system 100 includes a wellhead system 102 that includes components for configuring and controlling deployment in terms of insertion and withdrawal of a test string 104 within the wellbore 107. The test string 104 may comprise multiple connected drill pipes, coiled tubing, or other downhole fluid conduit that is extended and retracted using compatible drill string conveyance components (not depicted) within the wellhead system 102. In some embodiments, the wellbore or annular section of the wellbore may in part form the conduit as a fluid path from the surface to the bottom hole assembly (BHA). In some embodiments, the conduit may be formed in part by a combination of conduits.

The test string 104 is utilized as the conveyance means for a test tool 110 that is attached via a connector section 112 to the distal end of test string 104. For example, the test tool 110 may be attached such as by a threaded coupling to connector section 112, which may similarly be attached by threaded coupling to the end of the test string 104. Alternatively, the test string 104 may be lowered into position by wireline, slickline, coiled tubing, or moved into position by tractor. In addition to providing the means for extending and withdrawing the test tool 110 within the wellbore 107, the test string 104 and the connector section 112 form or include internal fluid conduits through which fluids may be withdrawn from or provided to the test tool 110. The test string 104 includes fluid connectors and electrical connectors. The function of the fluid connectors and electrical connectors may be divided into more than one part, one for the electrical connection and one for the fluid connection. In the embodiment for which the conveyance system is the wireline and the upper portion of the fluid conduit is the wellbore 107, the fluid connector may be disposed on the exterior of the test string 104 open to the wellbore 107 to draw fluid from the wellbore 107. In this embodiment the wellbore 107 may be isolated at surface from atmospheric pressure, and the wellbore 107 pressurized to drive fluid to the test tool 110.

In some embodiments, a fluid pill is introduced into the mud flowing into the wellbore. The fluid pill can be positioned in the wellbore where an injection tool is to be performed. The test tool 110 can be an injection tool that can be positioned in the zone with the fluid pill. Also, the test tool 110 can include a filter to remove a particulate from a fluid pill prior to injection of the injection fluid into the zone for the injection test.

Communication and power source coupling are provided to the test tool 110 via a wireline cable 114 having one or more communication and power terminals within the wellhead system 102. In some embodiments, the wireline 114 is connected to the test tool 110 following positioning of the test tool 110 within the wellbore 107. For instance, the connector section 112 may include a seating for a wet latch 116 that is inserted into the test string 104 such as via a side entry portal 118. The wet latch 116 may comprise an elastomeric dart that is attached to an end connector (not depicted) of the wireline 114. To connect the wireline 114 with the test tool 110, the wet latch 116 is pumped downward through the test string 104 using a fluid medium such as drilling mud until the wet latch 116 seats within the connector section 112 resulting in the end connector of the wireline 114 electrically connecting to the test tool 110.

The test tool 110 comprises components, including components not expressly depicted in FIG. 1, configured to implement fluid intake testing that facilitates the fluid injection testing. The test tool 110 includes flow control devices 120 for implementing and regulating inflow of formation and other fluids into the test tool 110 and outflow of drilling fluids, injection test fluids, and borehole cleaning fluids from the test tool 110. For example, the flow control devices 120 may comprise a combination of one or more valves and/or pumps mutually configured to provide flow pathways and flow inducement pressures for withdrawing formation fluids into the test tool 110 from the annular region of the wellbore 107 surrounding the test tool 110. The flow control devices 120 intake fluid from and inject fluid into the annular wellbore region via a set of one or more flow ports 122 within the connector section 112 and flow ports 124 within the test tool 110 itself.

In some embodiments, the flow ports 122 and 124 may be configured as orifices disposed at the body surface of the connector section 112 and the test tool 110, respectively. In addition or alternatively, the flow ports 122 and 124 may be configured as outwardly extending flow probes having a flow port positioned on or driven within an inner borehole surface 108 of the wellbore 107. The ports 122 and 124 may be incorporated between and/or integrated within isolation packers 130 and 132 as open orifices exposed within the wellbore 107 or as extended probes employed by wireline and LWD formation testers.

Figure 2A:
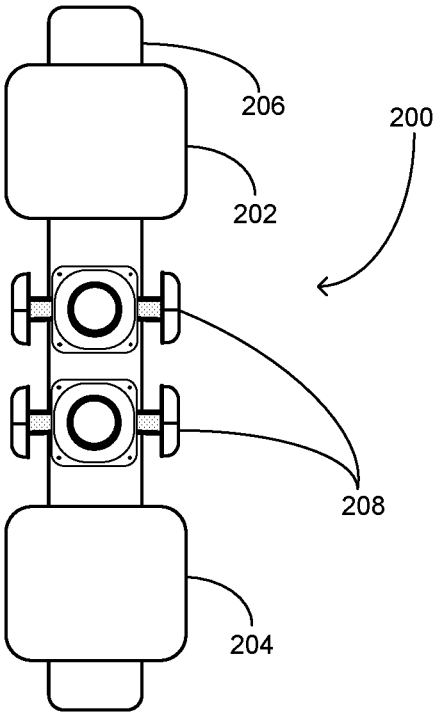
FIGS. 2A-2C depict example packer and probe assemblies, according to some embodiments.
Figure 2B:
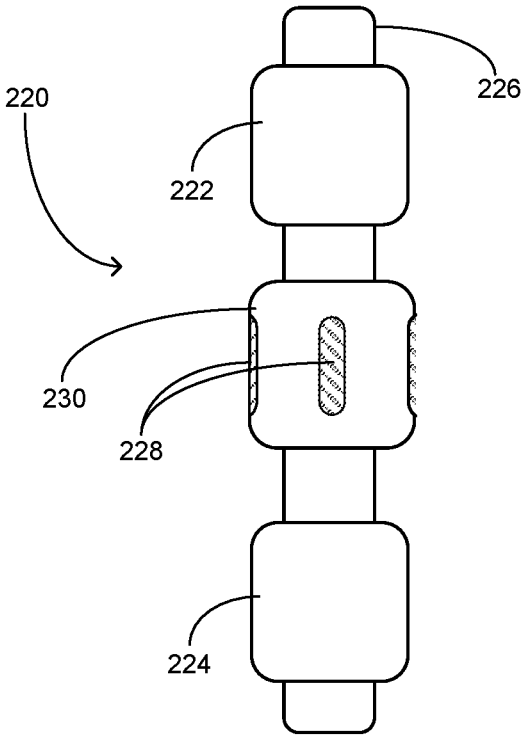
Figure 2C:
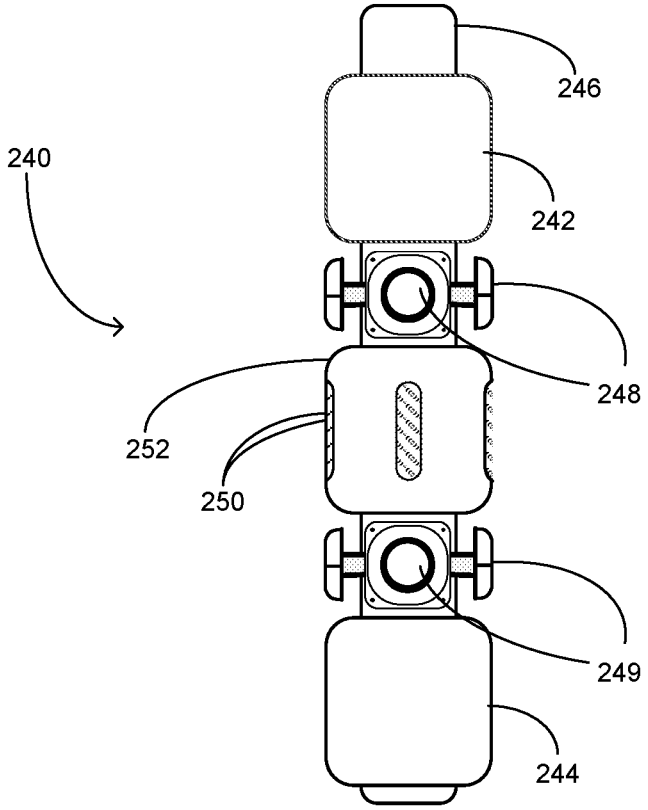

To illustrate, FIGS. 2A-2C depict example packer and probe assemblies, according to some embodiments. These example packer probe assemblies may be incorporated into the test tool 110. FIG. 2A illustrates a packer and probe assembly 200 comprising a pair of inflatable packers 202 and 204 deployed on a test tool body 206. In this embodiment, multiple probes including probes 208 extend radially outwardly from the test tool body 206 in the isolation zone between the inflatable packers 202 and 204. FIG. 2B depicts a packer and probe assembly 220 comprising a pair of inflatable packers 222 and 224 deployed on a test tool body 226. In this embodiment, multiple probes including a probe 228 are deployed at the surface of a packer 230 that is disposed in the isolated zone between the packers 222 and 224. FIG. 2C illustrates a packer and probe assembly 240 comprising a pair of inflatable packers 242 and 244 deployed on a test tool body 246. In this embodiment, a first set of multiple non-packer probes including non-packer probes 248 are deployed between packers 242 and 252, and a second set of non-packer probes 249 are deployed between packers 252 and 244. A set of packer probes including packer probes 250 are deployed on a packer 252 that is disposed between non-packer probes 248.

Figure 2D:
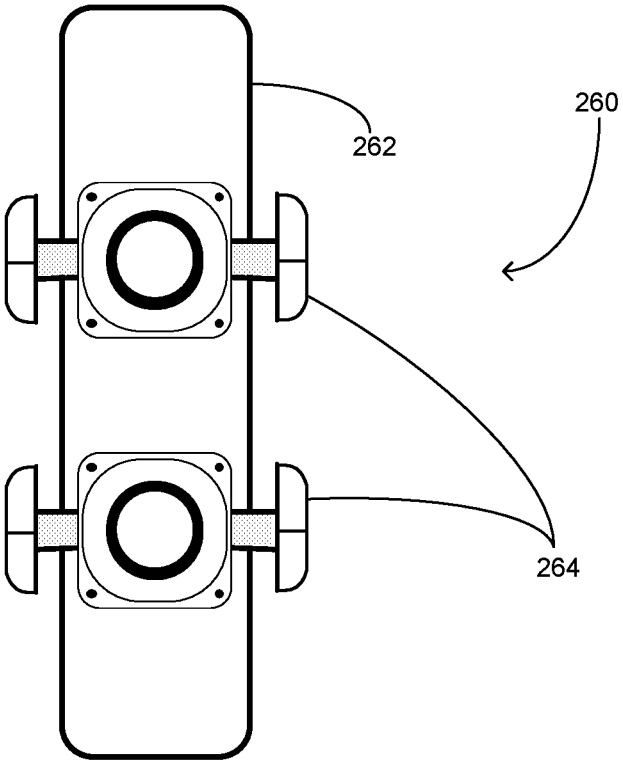
FIGS. 2D and 2E depict example probe assemblies that may be deployed without packers, according to some embodiments.
Figure 2E:
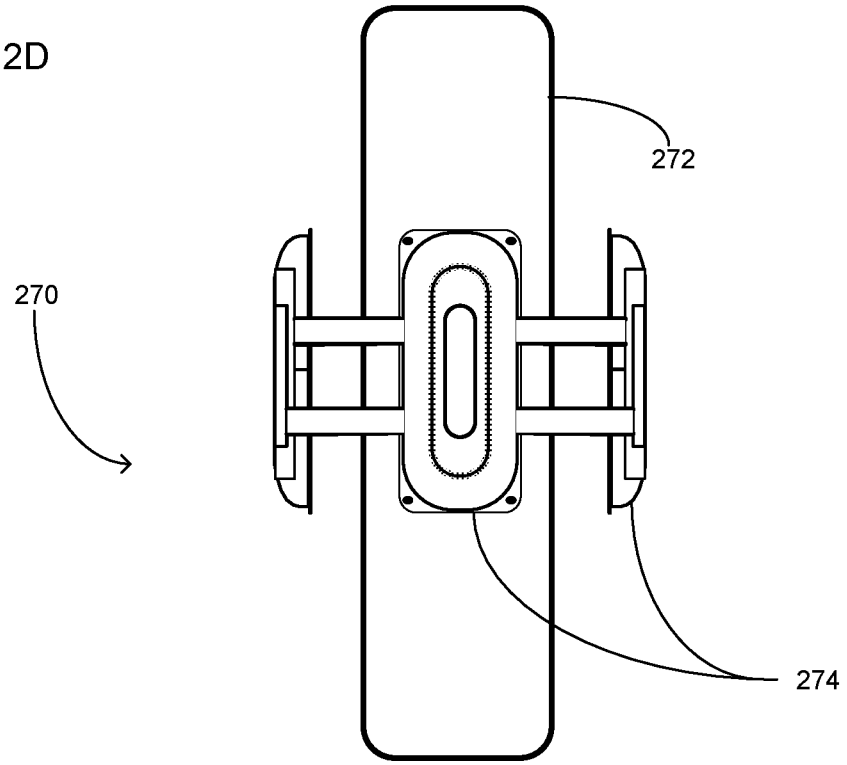

The probes 208 in FIG. 2A and the probes 248 and 249 in FIG. 2C may be self-sealing in terms of including a seal pad surrounding the intake orifice. In such embodiments, the test tool may not require packers to provide isolation zones during testing and the isolation zone is the enclosed volume sealed by the seal pad. To illustrate, FIGS. 2D and 2E depict example probe assemblies that may be deployed without packers, according to some embodiments. FIG. 2D depicts a probe assembly 260 comprising multiple outwardly extensible probes including probes 264 deployed on a test tool body 262. The probes 264 are self-sealing circular probes that may be extended outwardly from the test tool body 262 to contact a portion of a wellbore wall surface and form an isolation zone thereon. FIG. 2E depicts a probe assembly 270 comprising multiple outwardly extensible probes including probes 274 deployed on a test tool body 272. The probes 274 are self-sealing focused oval probes that may be extended outwardly from the test tool body 262 to contact a portion of a wellbore wall surface and form an isolation zone thereon.

Returning to FIG. 1, the test tool 110 further comprises measurement instruments 128 for measuring, detecting, or otherwise determining properties of the subsurface formation during injection testing. For example, the measurement instruments 128 may include one or more pressure detectors for determining formation fluid pressures within isolated or non-isolated portions of the wellbore 107. The pressure detector(s) within the measurement instruments 128 may include a pressure recorder for recording a pressure transient comprising pressure values measured over a time period such as a pressure rise or build up period following an intake flow and/or a pressure drop or fall off period following an injection flow. The measurement instruments 128 may further include a flow rate detector for measuring and recording flow rates of fluids injected from the test tool 110 into a formation 117. The measurement instruments 128 further include fluid properties detectors for measuring composition, fluid viscosity and compressibility and/or environment properties such as temperature and pressure.

The test tool 110 can be configured to communicate the measured fluid property values as well as injection test operation information to a surface data processing system (DPS) 140. The test tool 110 may directly communicate measurement and other information via the wireline 114 and/or via an alternate communication interface 134 such as but not limited to computer memory devices and systems. The test tool 110 may communicate to the DPS 140 via a telemetry link 136 using the communication interface 134 if, for example, the wireline 114 is not included in the system or does not include a sufficient communication channel. The telemetry link 136 includes transmission media and endpoint interface components configured to employ a variety of communication modes. The communication modes may comprise different signal and modulation types carried using one or more different transmission media such as acoustic, electromagnetic, and optical fiber media. For example, pressure pulses can be sent from the surface using the fluid in the drill pipe as the physical communication channel and those pulses received and interpreted by the test tool 110.

While depicted as a single box for ease of illustration, the DPS 140 may be implemented in any of one or more of a variety of standalone or networked computer processing environments. As shown, the DPS 140 may operate above a terrain surface 103 within or proximate to the wellhead system 102, for example. The DPS 140 includes processing and storage components configured to receive and process injection test procedure and downhole measurement information to generate flow control signals. The DPS 140 may be further configured to process injection test data received from the test tool 110, such as pressure transient data, to determine permeability, physical extent, and hydrocarbon capacity of the formation 117. The DPS 140 comprises, in part, a computer processor 142 and a memory device 144 configured to execute program instructions for generating the flow control signals and the formation properties information. A communication interface 138 is configured to transmit and receive signals to and from the test tool 110 as well as other devices within the formation test system 100 using a communication channel with the wireline 114 as well as the telemetry links 136 and 152.

DPS 140 is configured to control various flow control components such as surface and downhole pumps and valves to enable coordinated transport, including initial injection fluid mixing and fluid separation during transport to formation test sites within wellbore 107. Executing as loaded within memory 144, an injection controller application 146 is configured to implement intake fluid flow testing in coordination with injection flow testing. Injection controller 146 is configured using any combination of program instructions and data to process flow control system configuration information in conjunction with injection procedure parameters to generate the flow control signals. The flow control system configuration information may include pump flow capacities and overall fluid throughput capacities of the surface and sub-surface flow control networks. Injection controller 146 includes an injection adapter application 148 that is configured to modify flow control signals and/or generate injection fluid component mixing instructions/signals based, at least in part, on fluid and formation properties measurement information generated and collected by test tool 110 such as during fluid intake testing.

Injection controller 146 is configured, using a combination of program instructions and calls to control activation of flow control devices including a pair of pumps 168 and 170. Each of pumps 168 and 170 is a fluid transfer pump such as a positive-displacement pump. Each of pumps 168 and 170 is configured to drive fluid from a respective fluid source into and through test string 104 via porting components 160. In the depicted embodiment, pump 168 is configured to pump injection fluid for injection testing, and pump 170 is configured to pump drilling fluid, sometimes referred to as drilling mud, in support of drilling and formation testing operations. For some embodiments, in which base oil is the injection fluid, it may be supplied directly from the drilling mud system by the drilling mud pump 170. Base fluid, such as base oil, may be generated from the drilling mud by downhole filtration. In other embodiments, the drilling mud pump 170 may be used to supply fluids other than a drilling fluid for injection operations. In this manner, pump 170 may be substituted for pump 168 to supply injection fluid during fluid injection operations. In such embodiments, pump 170 may connect directly to injection fluid sources 154 or 156 in addition to connecting to drilling fluid source 158. The wellhead system includes a recirculation line 174 driven by a recirculation pump 176 that recirculates the drilling fluid from wellbore 107 into drilling fluid source 158 such as when operating in drill mode and during downhole testing and sampling.

For embodiments in which the injection fluid is provided independently of the drilling mud system, pump 168 is configured to receive fluid from one or more injection fluid sources such as a first injection fluid source 154 and a second injection fluid source 156. Injection fluid source 154 contains or otherwise supplies an injection fluid having a different composition than the composition of fluid from fluid injection source 156. For example, the fluid supplied by injection fluid source 154 may comprise a primary injection fluid in the form of diesel, drilling fluid filtrate (oil or water or emulsion), and/or treated water such as treated sea water. Injection fluid source 156 may supply a secondary, additive-type fluid having a relatively high or low viscosity and be mixed with the primary injection fluid to form a viscosity adjusted injection fluid mixture to be transported downhole. Furthermore, additives may be mixed with one or both of fluid sources 154 and 156 to adjust the wettability characteristics of the injection fluid. Pump 170 is configured to receive fluid from a drilling fluid source 158, which may supply for example oil-based drilling mud. Pumps 168 and 170 are configured to drive fluid from a respective one or more sources into the fluid conduit formed by test string 104 via the porting components 160. One or multiple pumps may be configured in parallel or series with pumps 168 and/or 170 to achieve injection characteristics such as but not limited to injection pressure, flowrate and flowrate control. A throttling system may be used downhole within test tool 110, in the formation tester connector section 112, and/or within DPS 140 to control flow rate.

In some embodiments, formation test system 100 may be configured to obtain and utilize formation fluid as an optimally compatible injection fluid for injection test operations. For example, formation fluid may be withdrawn into test tool 110 via flow ports 122 and/or 124 with flow control devices 120 configured for fluid intake. The formation fluid may be pumped or otherwise driven into a downhole containment volume that may comprise downhole fluid containers. Alternatively, the downhole containment volume may comprise the upper, non-isolated portion of wellbore 107 and/or the upper piping portion of test string 104. For example, the formation fluid may be pumped into the upper portion of wellbore 107 via ports 181 that are controllably opened and closed via valves (not depicted) within drill string 104.

Whether collected within downhole containers, the upper portion of test string 104, and/or the upper portion of wellbore 107, the formation fluid may be applied as the injection fluid during formation pressure transient tests. If collected above test tool 110, for instance, the hydrostatic pressure head provides a pressure differential above formation pressure enabling the formation fluid to be injected back into the formation at a higher rate than withdrawn. In some embodiments, additional pressure may be applied by surface pumps 168 and/or 170 via porting components 160 to the fluid column within test string 104. If the formation fluid is withdrawn from the same zone for which it is be injected, then a wait time may be introduced to allow the formation pressure to reestablish steady state pressure between the withdraw and injection.

Each of pumps 168 and 170 may include a control interface (not depicted) such as a locally installed activation and switching microcontroller that receives activation and switching instructions from DPS 140 via telemetry link 152. For instance, the activation instructions may comprise instructions to activate or deactivate the pump and/or to activate or deactivate pressurized operation by which the pump applies pressure to drive the fluid received from a response of the fluid sources into and through test string 104. Switching instructions may comprise instructions to switch to, from, and/or between different fluid pumping modes. For instance, a switching instruction may instruct the target pump 168 and/or 170 to switch from low flow rate (low pressure) operation to higher flow rate (higher pressure) operation.

By issuing coordinated activation and switching instructions to pumps 168 and 170, DPS 140 controls and coordinates flows and flow rates of fluids from each of fluid sources 154, 156, and 158 through test string 104. Additional flow control, including individual control of flow from the fluid sources 154, 156, and 158 to pumps 168 and 170 is provided by electronically actuated valves 162, 164, and 166. Each of valves 162, 164, and 166 includes a control interface (not depicted) such as a locally installed microcontroller that receives valve position instructions from DPS 140 via telemetry link 152. For instance, the valve position instructions may comprise instructions to open, close, or otherwise modify the flow control position of the valve. Individually, or in combination with pump operation instructions, DPS 140 may control pressure and rate of flow from each of fluid sources 154, 156, and 158.

The components of formation test system 100 are configured to implement inflow and injection flow testing from which properties such as but not limited to formation mobility, permeability, porosity, rock-fluid compressibility, skin factor, anisotropy, reservoir geometry, and reservoir extent are determined. As shown, hydrocarbon formation 117 includes physical discontinuities 137*a*, 137*b*, and 137*c*, each representing either a formation edge or an internal formation discontinuity such as but not limited to a fault or low permeability zone that manifests as a pressure and/or fluid flow barrier. Traditional DSTs entail fluid intake flow rate and pressure transient testing to locate formation edges and internal formation discontinuities. However, logistical, safety, and environmental issues limit the rate at which fluid may be withdrawn such as by reducing wellbore pressure to induce inflow. Therefore, fluid intake test typically requires large volumes of fluid to be withdrawn at relatively low flow rates, resulting in substantial expense in terms of equipment overhead and otherwise to capture and contain the withdrawn formation fluid content.

In some embodiments, formation test system 100 addresses issues posed by traditional DST by implementing a dual phase formation test cycle in which a fluid inflow test phase precedes and facilitates a subsequent fluid injection phase. A formation test cycle may begin with drill string position components (not depicted) within wellhead 102 extending or retracting test string 104 to position test tool 110 at a formation test site within wellbore 107. With test tool 110 positioned, components such as a pump within flow control devices 120 deploys a pair of isolation packers 130 such as by inflating packers 130 to form hydraulic and pressure barriers to wellbore fluid above and below an isolated test zone formed between isolation packers 130. In some embodiments, the system may include an additional one or more packers such as buffer packers 132 that are deployed to form additional hydraulically isolated buffer zones to facilitate formation testing such as by providing a buffer to, for example, prevent or reduce pressure noise that may otherwise interfere with measurements within the isolated test zone. Buffer packers 132 may not make hydraulic contact with the formation (inside wall 108 of wellbore 107) and are pressurized above formation pressure above or below hydrostatic pressure. With buffer packers 132 deployed, pressure zones are formed in the wellbore space between packers 130 and 132. In the depicted embodiment, flow ports 129 and flow ports 131 which may comprise intake probes, are disposed between the upper and/or lower buffer packers 132 and the upper one of isolation packers 130 and may be used for fluid intake and/or fluid injection. Additionally, one or more probes may be used independent of buffer packers.

Following positioning of test tool 110, prior or subsequent to deployment of packers 130 and 132, wet latch 116 is pumped down to connector section 112 where it seats and effectuates connectivity of wireline 114 with test tool 110. Test string 104 may contain drilling fluid prior to pumping down of wet latch 116. In some embodiments, wellhead system 102 is configured to pump wet latch 116 down to connector section 112 using injection fluid such as from injection fluids source 154 and/or 156. Wet latch 116 may comprise a sealing plug such as a piston plug to separate the injection fluid (e.g., diesel) from the drilling fluid with test string 104. In some embodiments, wet latch 116 may comprise an elastomeric body member having brush contact edges or other soft elastomeric edges to form a substantially fluid impermeable seal against the inner conduit surface of test string 104. In this manner, wet latch 116 in addition to implementing wireline connection performs a conduit flushing function by flushing the drilling fluid out of test string 104 through an exit port provided by flow ports 122 or 124. In other embodiments, the conveyance system is the wireline, and therefore a wet latch is not used as the connector. In yet other embodiments, the drilling fluid mud is filtered at the BHA to provide drilling fluid base oil as an injection fluid. For this embodiment, the wellbore may form in part the conduit. The BHA in this embodiment would contain a filter section to produce a fluid that in part contains drilling fluid base oil.

Although the primary function of the DST BHA comprising test tool 110 and connector section 112 is to facilitate the injection of fluid into the formation, it may be configured to facilitate fluid inflow into the tool, such as for the purpose of cleaning the wellbore or for performing measurements on the formation fluids. Such capability may be provided by components such as pumps and valves. Reversible pumps may be used such that the same pump can be used for either outflow into the wellbore and inflow from the wellbore into the tool.

Following establishment of the isolated test and buffer zones and connection of wireline 114, test tool 110 and other components within formation test system 100 may implement a formation test preparation phase to optimize fluid intake testing particularly if wellbore 107 is an open borehole. Such test preparation phase may involve testing the injectability of the formation by pumping fluid into the wellbore, or testing the permeability of the formation by drawing in fluid from the wellbore. For example, wellhead system 102 such as may be controlled in part by DPS 140 in combination with a downhole pump within test tool 110 may drive injection fluid into the isolated test zone with mud cake intact on an inner surface 108 of wellbore 107 in order to measure the leak rate of the filter cake. For example, the leak rate may be determined by relatively small-scale injection and/or withdrawal of fluid from wellbore over a specified period and measuring the rate of fluid transfer to provide in situ information about the permeability of the wellbore mud cake layer.

The leak rate of the filter cake may be utilized to optimize subsequent drilling operations at or proximate wellbore 107 to optimize acquisition of formation fluid samples during the fluid intake test phase, or to help establish a cleaning program for removing the mud cake to facilitate injection. The fluid properties measured during the fluid intake phase may be used to extrapolate clean formation fluid properties as well as drilling fluid filtrate contamination levels such that fluid sampling and analysis begins at a point during fluid intake at which the fluid is relatively free of borehole contaminants. Further, the leak rate of the filter cake may be a significant parameter in interpreting the data from the fluid injection test in order to determine formation parameters such as but not limited to barriers to flow within the formation, reservoir extent, reservoir geometry, permeability, porosity and anisotropy.

The fluid inflow test phase may be performed with test string 104 containing injection fluid with wet latch 116 acting as a flushing plug that separates the drilling fluid initially contained in test string 104 from the injection fluid. The drilling fluid is swept out of test string 104 via flow ports 122, 129, and/or 124. If the fluid intake test is performed on a different test cycle, or with drilling fluid filling test string 104, another piston plug 172 is used to separate the drilling fluid from the injection fluid as the injection fluid sweeps test string 104. Each of piston plug 172 and subsequent piston plugs include a center hole through which wireline 114 passes as the plug is pumped downhole to plug receptacles within connector section 112 and/or test tool 110. A fluid such as a fluorocarbon that is neither soluble in water nor oil fluids, or the like, may also be used to separate the injection fluid from the filter cake and drilling fluid. In some embodiments, the selected fluid has a density between that of the injection fluid and the drilling fluid, and is not soluble in either the injection fluid or the drilling fluid.

To clean the isolated test zone and/or test tool 110 prior to the fluid intake test, a pump within flow control devices 120 may be actuated to flush test tool 110 with the injection fluid. The isolated test zone (i.e., annular space between packers 130 that makes hydraulic contact with the inner wall 108 of wellbore 107) may also be flushed with injection fluid to optimize subsequent intake and injection fluid testing. This may remove the filter cake from the region of wellbore 107 within the isolated test zone. This flushing of the tool and isolated test zone entails injecting injection fluid and evacuating fluid from the isolated test zone. The flushing may be accomplished by pumping the injection fluid into the isolated test zone and evacuating the resultant mixture at the top or bottom positions within the isolated test zone determined by fluid density. If the injection fluid is less dense than the drilling fluid, for example, a top down flushing of the drilling fluid and filter cake may be implemented by injecting nearer the top (e.g., from flow ports 122) and evacuating nearer the bottom (e.g., into flow ports 124). Alternatively, the isolated test zone may be cleaned with fluid from formation 117 in the process of a fluid intake test. In this embodiment, formation fluid is withdrawn from formation 117 thereby clearing the filter cake from the walls of the wellbore within the isolated test zone prior to the fluid injection test. Fluids drawn into test tool 110 may be expelled into the annulus section of the wellbore above the isolated test zone, in the annulus below the isolated test zone, in a storage container within test tool 110, or driven up through test string 104 for temporary storage.

In the absence of or following the preliminary isolated test zone flushing, the fluid intake phase of a formation test cycle begins with test tool 110 actuating one or more of flow control devices 120 such as a fluid intake valve. The valve actuation alone or in conjunction with negative pump pressure implements negative pressure within the isolated test zone between packers 130 that induces flow of formation fluid into test tool 110 such as via flow ports 122 or 124. During and following fluid intake test tool 110 performs fluid and formation properties testing. The fluid properties to be determined include composition, contamination level (with respect to drilling fluid filtrate), viscosity, compressibility, bubble point, and gas-to-oil ratio. The injection fluid may be tested using downhole sensors to determine fluid properties such as viscosity, density and or composition. The injection fluid may also be sampled downhole so that fluid properties may be later determined. The viscosity value determined in situ or from the sampled fluid may be used in combination with one or more pressure sensors to determine flow rate of the injection fluid at various stages throughout the injection testing.

Alternatively, a known pump rate may be used to calibrate two pressure gauges at different positions within the flow line of the BHA in order to directly measure flow rate. Such a measurement is improved by having a known injection fluid density, the height difference of the two different pressure sensors, and a zero flow reference to normalize the two pressure gauges. In some embodiments, test tool 110 determines fluid properties such as temperature and pressure by directly measuring using measurement instruments 128. Measured pressures may include sand face pressures within the isolated test zone and are used to determine a pressure rise transient determined over a period during and/or following the termination of the withdrawal of fluid from the isolated test zone. The pressure transient may be processed by components within test tool 110 and/or DPS 140 to determine near wellbore properties such as formation mobility or permeability. Pressures within the isolated buffer zones formed between packers 130 and 132 may also be measured to optimize computation of the isolated test zone pressures by, for example, cancelling low frequency pressure interference generated above and below the barrier zones. Methods for canceling such interference noise from outside the isolated test zone include but are not limited to autocorrelation techniques, or a physical mode fit of the location-based pressure measurements. These types of isolated test zone pressure measurement correction may also be implemented to correct pressure measurements performed for a corresponding fluid injection test.

Pressure measurements between the packers may account for effects such as deformation of the packers, in order to better determine formation properties. During the fluid inflow test a sample or samples may be acquired for subsequent laboratory analysis. Fluid intake tests may be performed within wellbore 107 at multiple locations, to find a suitable location for a fluid injection test, or to map the fluid variation within a reservoir to be used to better interpret formation properties from the injection test. Samples may be acquired from these multiple locations and/or at different stages of the fluid intake test at the different locations such as by flow ports 129 from the isolated buffer zone. Monitoring of the fluid properties may take place as a function of time or as a function volume of fluid flowed in. The fluid properties measured at different stages (for instance time based or volume based) of the fluid intake test may be interpreted to provide fluid properties of the clean representative formation fluid properties. Such an interpretation may be performed by extrapolating the fluid properties according to a model which describes the inflow test as a function of time or volume or interpreted with equation of state techniques during a single inflow test or across multiple inflow tests.

Samples of the formation fluid may be taken. Samples of the inflow fluid may be taken. Also, core samples of the rock from the zone of injection, near the zone of injection, or from proxy formations representing the zone of injection may be taken either before or after injections. Such core samples may be used to determine rock parameters such as but not limited to capillary pressure curves, saturation curves, or relative permeability curves regarding the formation fluid and injection fluid. Core samples may be tested directly with the fluid samples of injection fluid and formation fluid, or appropriate fluid proxies may be used. Such core measurements may be useful in determination of formation properties, especially in mixed phase systems. Further wettability effects can be tested on the cores with regards to the sampled or proxy fluids. Other methods of testing the rock may utilize rock cuttings from the zones of interest, near the zones of interest or from proxy formations representing the zones of interest. Further other methods of testing the rock may utilize digital rock calculations based on down hole or surface rock properties, including but not limited to down hole petrophysical logs such as electromagnetic logs, NMR logs, acoustic logs and nuclear logs. Such rock properties, fluid properties, and interactive rock and fluid properties may be used as part of an analytical model or digital model or proxy model such as but not limited to a machine learning proxy model, in order to invert formation and reservoir properties from the injection test.

Measurement instruments 128 may also perform fluid content analysis to determine properties such as viscosity, compressibility, and chemical composition. Measurement instruments 128 further include components configured to determine and record a pressure transient such as a pressure rise during and/or following the period over which formation fluid is withdrawn into test tool 110. The pressure transient information may be processed by processing components within measurement instruments 128 to calculate or otherwise determine a formation mobility, permeability, and/or anisotropy. Anisotropy measurements require a second probe distal to the isolated test zone and separate from the isolated buffer zone(s). Alternatively, the pressure transient information may be transmitted to DPS 140, which includes components such as formation model tool 150 that are configured to determine formation permeability based on the pressure transient information.

Prior to a fluid injection test phase, the fluid and formation properties data including but not limited to a combination of formation pressure and permeability and fluid composition, fluid viscosity, and fluid density are processed by DPS 140 to optimize the injection fluid composition and fluid injection parameters such as injection pressure and flow rate. Regarding injection fluid composition, injection controller 146 and injection adapter 148 are configured to select or generate by mixing, an injection fluid having a viscosity and/or a density and/or a wettability that matches formation fluid viscosity and/or density and/or wettability to within a threshold. Wettability for instance may be adjusted in order to match the expected wettability characteristics of the formation for instance if prior formation information is obtained, or adjusted based on the composition of the formation fluid, for instance from saturates, aromatics, resins, and asphaltene (SARA compositor) data.

In response to one or more of the received fluid and formation properties values including, for some embodiments, the values such as exceeding a threshold, injection controller 146 calls or otherwise executes injection adapter 148 to cause injector 148 to generate an adapted injection procedure. The injection procedure may specify an injection fluid composition which may comprise a combination of components from fluid sources 154 and 156 that most nearly matches the formation fluid viscosity. In addition to viscosity matching, injection adapter 148 may be configured to select or generate by mixing an injection fluid that matches other formation fluid properties such as density and salinity. For instance, if the injection fluid comprises salt water such as seawater, sulfate may be removed and/or other ions may be removed to prevent scale, swelling, or other formation damage. Scale inhibition components may also be added to the injection fluid. Oil based injection fluids such as but not limited to diesel or drilling fluid base oil, may contain compounds to prevent the precipitation of asphaltenes within the formation. One such compound is d-limonene, however, other compounds that exhibit scale inhibition may be utilized. Injection fluid containing in part base oil may be generated from drilling fluid by filtration. In other embodiments, injection fluid may be carried downhole in containers as part of the BHA.

In addition to regulating injection fluid composition, components within wellhead 102, DPS 140, and/or test tool 110 are configured to determine the flow rates and flow pressures applied during the fluid injection test phase. For instance, injection controller 146 and injection adapter 148 may be configured to determine and implement a fluid injection procedure that applies a flow rate and/or flow pressure that may be modified from a default flow rate/pressure based on formation permeability and other formation and fluid properties measured or otherwise generated by the fluid intake testing. Injection controller 146 may apply other parameters to limit or otherwise determine flow rates and pressures. For example, injection controller 146 in conjunction with components in wellhead 102 and test tool 110 may set and maintain the injection flow rate and/or flow pressure below the fracture pressure of formation 117 and further to remain below the static wellbore pressure within the isolated test zone.

Based on the adapted injection procedure, pump and valve control signals are transmitted via communications interface 138 to the control interfaces of pumps 168 and 170 and valves 162, 164, and 166 to implement coordinated flow of fluids from fluid sources 154, 156, and 158 through test string 104 at specified flow rates and/or pressures. Flow control components 120 within test tool 110 may be utilized to facilitate implementation of the specified flow rates and pressures such as by flow rate and/or flow pressure throttling. Additionally or in the alternative, flow rates and pressures may be controlled by directing the injection fluid to one or more pumps within test tool 110 that may regulate flow rate locally. In some embodiments, measurement instruments 128 and flow control components 120 may operate in conjunction to maintain relatively precise downhole control of the flow rates and pressures. For instance, measurement instruments 128 may include components for measuring the injection fluid flow rate and or flow pressure and one or more of flow control components 120 such as pumps and adjustable valves may be configured to modify flow rate and/or pressure accordingly. Such throttling control functionality may be implemented by flow control devices such as pumps, valves, and local controllers within test tool 110. The flow rate measurement may be calibrated downhole using the known flowrate of a pump for an injection fluid. The calibration may include at least one of a single known flow rate, a static measurement (no flow), and/or multiple known flow rates. The flow rates including a static measurement may be achieved with a pump such as a metered pump for reference. Thereby if at a later time the pump is bypassed, the flow measurement still provides an in situ calibrated value. The flow device may comprise the combination of two pressure gauges at two different locations within the flow line of the BHA. If two pressure gauges are used, a measured or known density of the injection fluid may be utilized to correctly account for gauge offset.

Injection controller 146 is configured to begin the injection procedure following a fluid intake phase or otherwise when the formation fluid pressure within the isolated test zone returns to steady-state formation reservoir pressure. The steady-state pressure condition may be determined by test tool 110, which may transmit a corresponding signal to DPS 140. To implement and regulate the pressurized application of the injection fluid, flow control and injection fluid selection/mixing instructions generated by injection controller 146 are transmitted to corresponding flow control components. In response to the instructions, the flow control components, such as pumps 168 and 170 and valves 162, 164, and 166 drive instruction-specified quantities of fluids from fluids sources 154, 156, and 158 into test string 104 at instruction-specified intervals corresponding to specified injection volumes. The fluids are transported via test string 104 into and through flow conduits and outlet ports within test tool 110. The injection flow rate may be maintained at a constant rate, which if not feasible, may be compensated for during post-processing using formation model tool 150.

The volume of injection fluid applied during the fluid injection test may depend on formation reservoir properties with respect to the intended reservoir extent to be monitored and the accuracy of the pressure detectors (e.g., pressure gauges) within test tool 110. For example, in 1000 millidarcy (md) formations having fluids at approximately 0.5 centipoise (cp), approximately 175 barrels of injection fluid is required to detect pressure/permeability barriers such as barriers 137*a*-137*c*, positioned up to 500 meters from the wellbore. This calculation may depend on the type of formation model used and may be analytically estimated or estimated by forward modeling simulations such as may be performed by a numerical formation modeling tool 150. The volume calculation may also be determined based on empirical methods or analogous comparison to offset wells located within a specified distance.

During injection of the injection fluid through test string 104 as throttled by test tool 110, the flow rate and wellbore pressure within the isolated test zone are measured by measurement instruments 128. Injection concludes with a sudden stoppage of the injection fluid flow with secondary plug 172 released from a surface holder into test string 104. Secondary plug 172, like wet latch 116, may include brush contacts or elastomeric contacts at its outer edges that contact the inner surface of the conduit within test string 104 and brush contacts or elastomeric contacts on the edge of the center hole through which wireline 114 passes. In this manner, secondary plug 172 keeps the injection fluid separate from driving secondary plug 172 in order to sweep test string 104 free of the injection fluid. In some embodiments, the action of secondary plug 172 reaching the bottom of wet latch 116 would both stop the flow of injection fluid into the formation and divert the drilling fluid flow into the annular region outside test string 104 and test tool 110. Test tool 110 transmits a signal to DPS 140 to initiate the substantially simultaneous deactivation of pumps 168 and 170.

In some embodiments multiple plugs may be used to separate multiple injection fluids. The plugs may be preloaded into the conduit system and deployed on demand. Alternatively, a liquid plug may be used in vertical or deviated wells. Such a liquid plug may have the advantage that it may be more easily deployed on demand and without substantial limit to the number of plugs used. Such a liquid plug would preferably have a density between that of the drilling fluid and the injection fluid, or between densities of subsequent injection fluids. The ideal fluid would not be soluble in either fluid being separated. Examples of such fluids include fluorocarbons, oils, or water. The density of such liquids may be adjusted to meet the specified criteria. The density of water may be raised with salts or lowered with compounds such as salts including but not limited to organic salts, or highly water-soluble organic compounds such as methanol, other alcohols.

Following stoppage of fluid injection, a pressure transient within the isolated test zone in the form of a pressure fall is detected and recorded by measurement instruments 128. Specifically, pressure at the sand face within the isolated test zone will decrease toward reservoir pressure as the injection fluid dissipates within the formation. The pressure drop information is transmitted by test tool 110 to DPS 140 and processed by formation modeling tool 150 to determine formation properties such as formation permeability and flow discontinuities (also referred to as pressure discontinuities or permeability discontinuities) such as discontinuities 137*a*-137*c*.

Formation model tool 150 processes the pressure drop transient detected subsequent to injection similar to the processing of pressure rise information for the intake test but with a fluid (the injection fluid) that is not an exact match in terms of one or more properties such as viscosity and density with the formation fluid. By minimizing the differences, particularly in viscosity, between the injection fluid and the formation fluid, the mathematical processing becomes increasingly similar to that of a fluid intake DST. However, forward modeling a formation simulation may allow interpretation of the pressure rebound to include differences in fluid properties. In some embodiments, laboratory data from the sampled fluid from the fluid intake test or another source may provide more accurate fluid properties with which to interpret the fluid intake test formation properties results. A fluid compositional gradient defined by formation testing data, or multiple formation testing samples, may also be used with forward model reservoir simulations in order to more accurately interpret the extent of the reservoir and internal reservoir flow barriers based on the determined permeability/pressure barriers. The gradient also may provide possible near wellbore damage (skin effect). Forward modeling may include analytical test design and interpretation of pressure derivative and superposition plot or numerical simulation of the whole process. Combining all data into numerical and analytical modeling also provides an overall estimate of the well performance (injectivity/productivity) and possible fluid displacement dynamic near the wellbore.

While formation test system 100 is described as being deployed for determining formation properties such as permeability, capacity, and naturally occurring discontinuities such as formation boundaries and internal material discontinuities, it should be noted that system 100 may also be operable for fracture analysis testing in which a fracture is intentionally created and tested. Such procedures are typically called a minifrac and can be analyzed using leakoff or flowback pressure transients to determine the fracture initiation, propagation, closure pressure (minimum horizontal stress), fracture half-length, and other formation properties such as permeability.

In some embodiments, test tool 110 includes a fluid intake port or probe located outside as well as within the isolated test zone. For example, a monitor probe may be located along wellbore 107 within one of the barrier zones between one of packers 130 and a proximate one of packers 132. Prior to injection of the injection fluid within the isolated test zone, the isolated buffer zone containing the monitor probe may be primed to make hydraulic contact from/with the formation that is a difference from the isolated buffer zone that is not primed. Differential pressure information obtained from the monitored buffer zone and the test zone may be processed by components of test tool 110 and/or DPS 140 to measure or otherwise determine formation anisotropy during or after the fluid injection test.

In the embodiment depicted in FIG. 1, the isolated buffer zones between the packers 130 and 132 can be monitored (such as by measurement instruments) to measure properties of fluid withdrawn by the flow ports 129 to detect pressure transients. This may require an initial test to determine a pressure difference between at least one of the buffer zones and the isolated test zone with an injection of fluid followed by a shut-in to establish hydraulic communication with the formation. Once the pressure has stabilized in the buffer zone(s) and the test zone, the extended injection test can start. During the extended injection, testing the pressures in the isolated buffer and test zones can be monitored to determine additional formation properties such as permeability anisotropy or near well bore structures such as layering and vertical flow barriers. Additional tests can be performed in the isolated buffer and test zones before or after the extended injection test and the pressures monitored in all isolated zones for further analysis.

Example Operations

Example operations for performing reverse drill stem testing are now described. FIG. 3 depicts a flowchart of example operations for reverse drill steam testing, according to some embodiments. At least a portion of the operations of a flowchart 300 of FIG. 3 can be performed by the example formation test system of FIG. 1 and the example packer and probe assemblies depicted in FIGS. 2A-2E. Operations of the flowchart 300 start at block 302.

Figure 4:
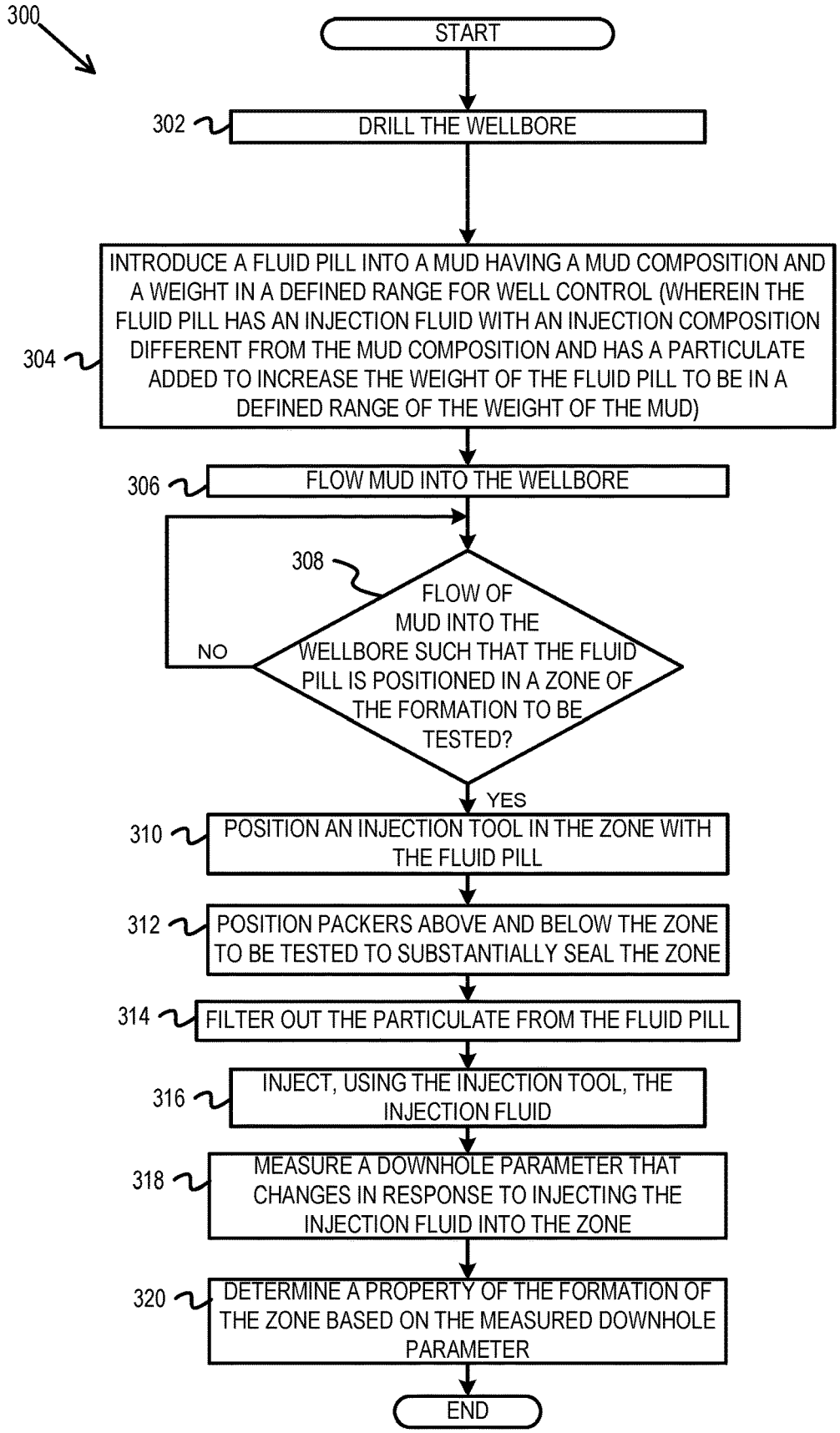
FIG. 4 depicts an example drilling system that may be utilized to deploy DST tools and potentially other logging tools, in some embodiments.
Figure 4:
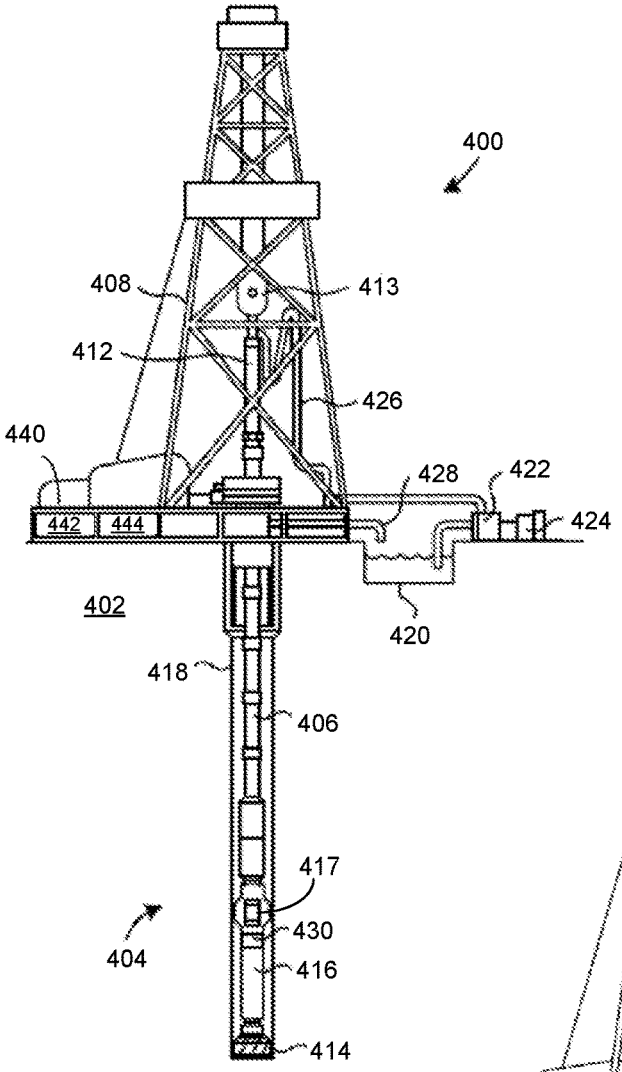

At block 302, a wellbore is drilled. For example, with reference to FIG. 1, the wellbore 107 has been drilled into the formation 117. An example drilling system with a drill string (pipe) for drilling the wellbore is depicted in FIG. 4 (which is further described below).

At block 304, a fluid pill is introduced into a mud having a mud composition and a weight in a defined range for well control, wherein the fluid pill has an injection fluid with an injection composition different from the mud composition and has a particulate added to increase the weight of the fluid pill to be in a defined range of the weight of the mud. For example, with reference to FIG. 1, a fluid pill can be added into mud being pumped into the wellbore 107 by the pump 170.

At block 306, the mud flows into the wellbore. For example, with reference to FIG. 1, the mud (with the added fluid pill) can then be pumped into the wellbore 107 by the pump 170.

At block 308, a determination is made of whether flow of the mud into the wellbore is such that the fluid pill is positioned in the zone of the formation to be tested. For example, with reference to FIG. 1, the injection controller 146 can control the pump 170 such that the pump 170 pumps the mud into the wellbore 107 until the fluid pill would be at a depth of the zone of the formation to be tested.

At block 310, an injection tool is positioned in the zone with the fluid pill. For example, with reference to FIG. 1, the test tool 110 can be conveyed into the wellbore 107 at the distal end of the test string 104 that can include drill pipes. Alternatively, the test tool 110 can be coupled to a wireline for conveyance into the wellbore 107.

At block 312, packers are positioned above and below the zone to be tested to substantially seal the zone. For example, with reference to FIG. 1, the packers 130 and 132 can be positioned above and below the zone to be tested.

At block 314, the particulate is filtered out from the fluid pill. For example, with reference to FIG. 1, the test tool 110 can include a filter that is configured to be able to filter out the particulate that has been added to the fluid pill for the added weight.

At block 316, the injection fluid is injected into the zone using the injection tool. For example, with reference to FIG. 1, the test tool 110 can inject the injection fluid in the fluid pill (after filtering out the particulate) into the zone of the formation to be tested. While the flowchart 300 is described in reference to one fluid pill, as described above, example embodiments can include multiple fluid pills. The multiple fluid pills can be for one zone or multiple zones of the formation to be tested. The multiple fluid pills for one zone can be adjacent to each other and/or separated by mud. In some embodiments with multiple fluid pills for one zone, each fluid pill can be a separate customized injection fluid with different properties. In such embodiments, a same zone can be tested with these different customized injection fluids to provide a more accurate evaluation of the zone. For example, each customized injection fluid could have a different viscosity, a different flow rate, etc. Alternatively or in addition for embodiments with multiple fluid pills for a same zone, one or more fluid pills can include a fluid to clean the flow path into the zone prior to the injection test. For example, a fluid pill can include a surfactant to clean the flow path for the injection fluid. A subsequent fluid pill having a customized injection fluid can then be positioned in this same zone to be injected into the formation for formation testing and evaluation.

At block 318, a downhole parameter that changes in response to injecting the injection fluid into the zone is measured. For example, with reference to FIG. 1, the test tool 110 can be used to perform a fall off test by measuring a pressure of the zone as it changes over time. The injection fluid can be at or near the hydrostatic pressure while the formation is at some lower pressure. After the injection fluid flows into the formation and shut in, the pressure of the formation may be at or near the hydrostatic pressure. However, over time the pressure will return back to the formation pressure prior to the injection.

At block 320, a property of the formation of the zone is determined based on the measured downhole parameter. For example, with reference to FIG. 1, a computer downhole and/or at the surface can determine a property of the formation of the zone based on the measure downhole parameter. To illustrate, the rate of the fall of the pressure can be indicative of the hydrocarbon bearing properties of the formation. Operations of the flowchart 300 are complete.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing. The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Example Systems

FIG. 4 depicts an example drilling system that may be utilized to deploy DST tools and potentially other logging tools, in some embodiments. A drilling system 400 is configured to include and use DST components for measuring properties of a formation and downhole material such as downhole fluids. The DST components within a tool string 416 may be utilized to collect formation properties data in either a drilling configuration as depicted in FIG. 4 and/or in a non-drilling configuration in which drill piping is used such as depicted in FIG. 1. In the depicted drilling configuration, the DST components are deployed and operated within a tool string 416 that is coupled to an upper portion of drill pipe in a drill string 406 that terminates in a drill bit 414. The DST components within tool string 416 may complement logging tools 417 also deployed by drilling system 400 for collecting test data via measurement-while-drilling (MWD) and/or a logging-while-drilling (LWD) operations. In such embodiments, MWD and/or LWD logging data may be collected by logging tools 417 during and between drilling operation intervals. Between drilling operation intervals during which drill string 406 is relatively stationary, the DST components within tool string 416 may be utilized to collect formation properties data.

Drilling system 400 may be configured to drive a bottom hole assembly (BHA) 404 positioned or otherwise arranged at the bottom of drill string 406 extended into the earth 402 from a derrick 408 arranged at the surface 410. Derrick 408 may include a kelly 412 and a traveling block 413 used to lower and raise kelly 412 and drill string 406. BHA 404 may include drill bit 414 operatively coupled to tool string 416 that may be moved axially within a drilled wellbore 418 as attached to the drill string 406. During operation, drill bit 414 penetrates the earth 402 and thereby creates wellbore 418. BHA 404 may provide directional control of drill bit 414 as it advances into the earth 402. Tool string 416 can be semi-permanently mounted with various measurement tools such as, but not limited to, the DST tools and components depicted in FIGS. 1, 3, 4, and 6. In some embodiments, the DST tools and components may be self-contained within tool string 416, as shown in FIG. 4.

Fluids such as drilling fluid and/or injection fluid from a fluid tank 420 may be pumped downhole using a pump 422 powered by an adjacent power source, such as a prime mover or motor 424. For example, a drilling fluid may be pumped from the tank 420, through a stand pipe 426, which feeds the drilling fluid into drill string 406 and conveys the same to drill bit 414. The drilling fluid exits one or more nozzles arranged in drill bit 414 and in the process cools drill bit 414. After exiting drill bit 414, the drilling fluid circulates back to the surface 410 via the annulus defined between wellbore 418 and drill string 406, and in the process, returns drill cuttings and debris to the surface. The cuttings and mud mixture are passed through a flow line 428 and are processed such that a cleaned drilling fluid is returned down hole through stand pipe 426. During injection operations, injection fluid may be pumped from tank 420 or another source through all or a portion of the surface and downhole drilling fluid conduits such as stand pipe 426 and drill string 406. The injection fluid passes through drill string 406 and into fluid injection components such as flow control devices and fluid ports within tool string 416.

Tool string 416 may further include a measurement tool 430 similar to the measurement instruments 128 described with reference to FIG. 1. Measurement tool 430 may be configured to measure, detect, or otherwise determine properties of the intake fluid flow and fluid property metrics for wellbore fluids and for detecting fluid pressure within wellbore 418 during injection testing. Measurement tool 430 may be controlled from the surface 410 by a computer 440 having a memory 442 and a processor 444. Accordingly, memory 442 may store commands that, when executed by processor 444, cause computer 440 to perform at least some steps in methods consistent with the present disclosure.

Figure 5:
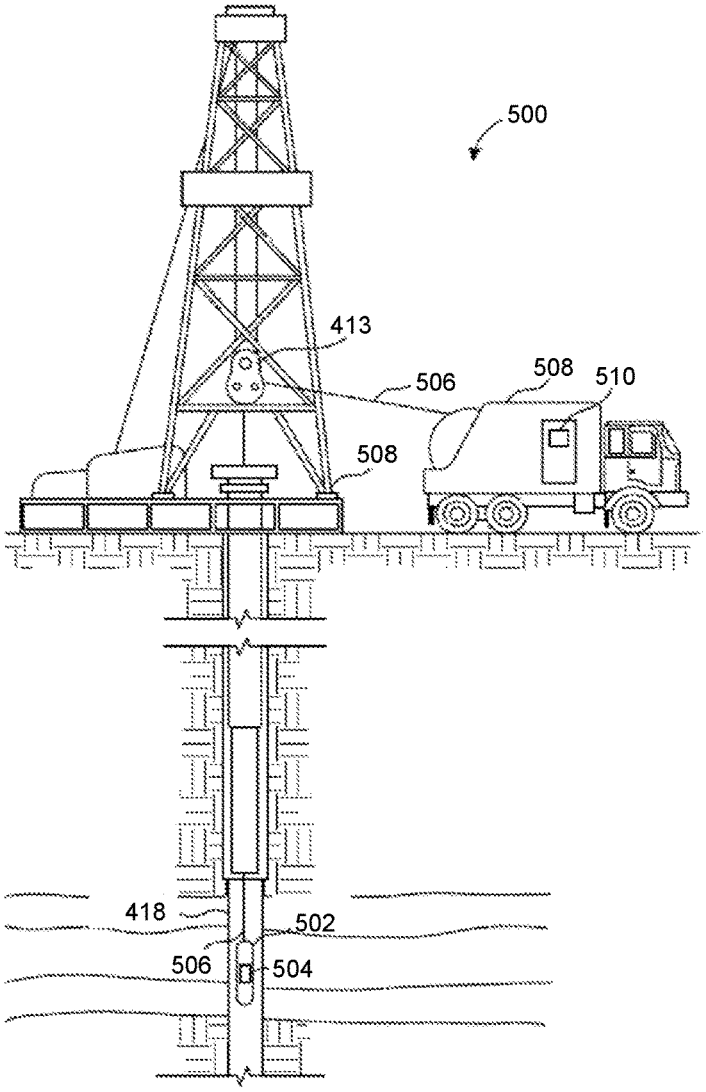
FIG. 5 depicts an example wireline system that may be utilized to deploy DST tools and potentially other logging tools, in some embodiments.

FIG. 5 depicts an example a wireline system that may be utilized to deploy DST tools and potentially other logging tools, in some embodiments. In some embodiments, wireline system 500 may be configured to use a formation test tool deployed within a DST string. After drilling of wellbore 418 is complete, it may be desirable to determine details regarding composition of formation fluids and associated properties through wireline sampling. Wireline system 500 may include a DST string 502 that forms part of a wireline deployment and operation of a DST string that can include one or more DST components 504, as described herein. Wireline system 500 may include the derrick 408 that supports the traveling block 413. DST string 502, similar to the depicted DST strings and BHAs shown FIGS. 1 and 3-6, may include components such as a probe or sonde, may be lowered by a wireline cable 506 into wellbore 418.

DST string 502 may be lowered to potential production zone or other region of interest within wellbore 418 and used in conjunction with other components such as packers and pumps to perform well testing and sampling. More particularly, DST string 502 may include test tool 504 comprising components such as those depicted with reference to test tool 110 in FIG. 1 and with reference to DST string 502 in FIG. 5 arranged therein. Test tool 504 may be configured to measure formation properties including formation fluid properties, and any measurement data generated by DST string 502 and formation test tool 504 can be real-time processed for decision-making, or communicated to a surface logging facility 508 for storage, processing, and/or analysis. Logging facility 508 may be provided with electronic equipment 510, including processors for various types of data and signal processing including perform at least some steps in methods consistent with the present disclosure.

Example Computer

Figure 6:
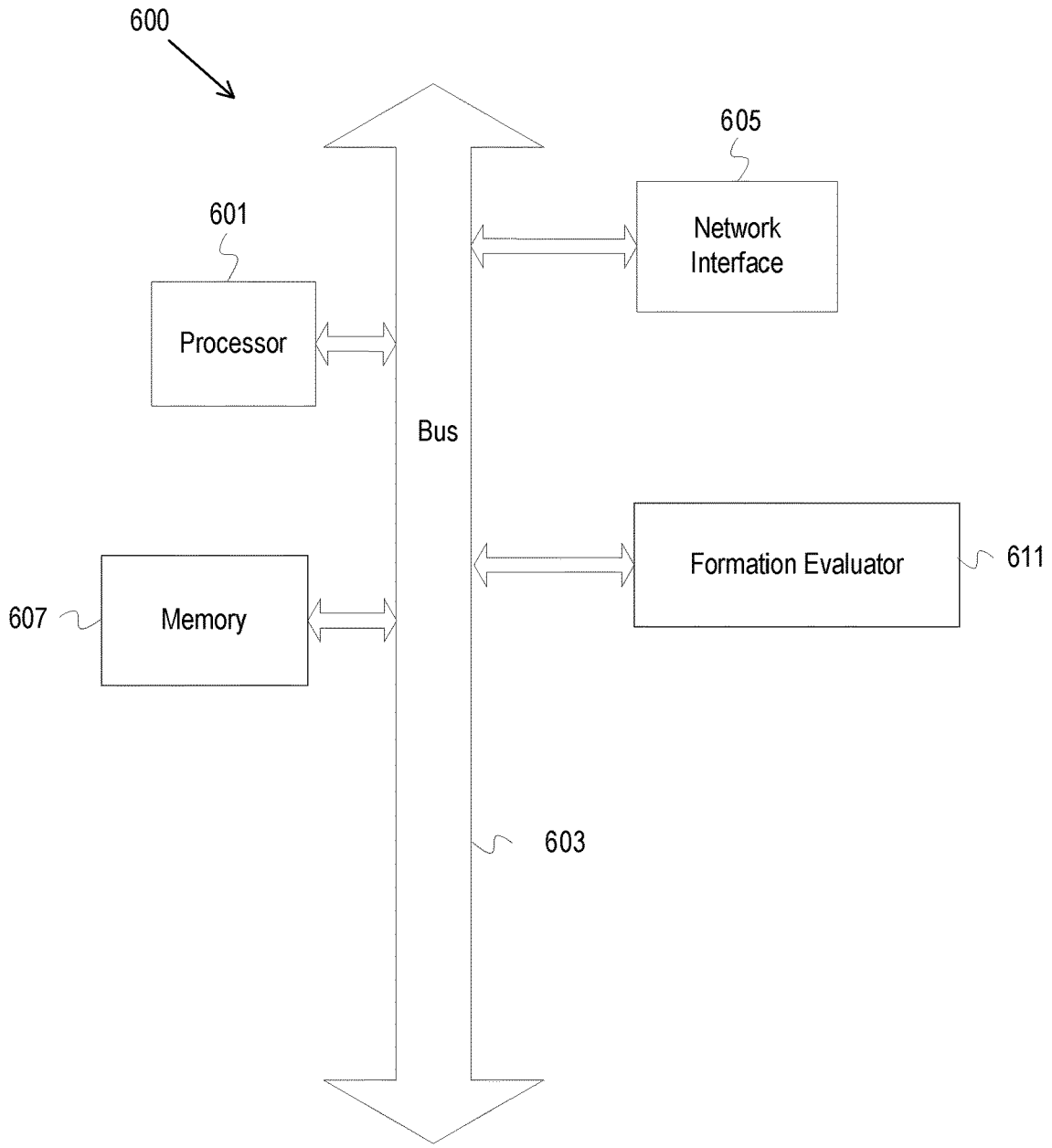
FIG. 6 depicts an example computer, according to some embodiments.

FIG. 6 depicts an example computer, according to some embodiments. In FIG. 6, a computer 600 includes a processor 601 (possibly including multiple processors, multiple cores, multiple nodes, and/or implementing multi-threading, etc.). The computer 600 includes a memory 607. The memory 607 may be system memory or any one or more of the above already described possible realizations of machine-readable media. The computer 600 also includes a bus 603 and a network interface 605. The computer 600 also includes a formation evaluator 611. The formation evaluator 611 can determine properties of the formation based on the measured downhole parameters (as described above). Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

While the aspects of the disclosure are described with reference to various implementations and exploitations, it will be understood that these aspects are illustrative and that the scope of the claims is not limited to them. In general, techniques for reverse drill stem testing as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Embodiment 1: A method comprising: flowing a mud into a wellbore, the mud having a mud composition and having a weight in a defined range; introducing a fluid pill into the mud flowing into the wellbore, the fluid pill having an injection fluid with an injection composition that is different from the mud composition, wherein a particulate has been added to the injection fluid to increase the weight of the fluid pill to be in the defined range; and after flowing the mud into the wellbore such that the fluid pill is positioned at a depth in the wellbore that includes a zone of a surrounding subsurface formation, performing the following, filtering out the particulate from the injection fluid downhole in the wellbore; injecting, after the filtering, the injection fluid into the zone; measuring a downhole parameter that changes in response to injecting the injection fluid into the zone; and determining a property of the surrounding subsurface formation of the zone based on the measured downhole parameter that changes in response to injecting the injection fluid into the zone.

Embodiment 2: The method of Embodiment 1, further comprising: positioning an injection tool in the zone, the injection tool having a filter, wherein filtering out the particulate comprises filtering out the particulate from the injection fluid using the filter.

Embodiment 3: The method of Embodiment 2, wherein injecting comprises injecting, using the injection tool, the injection fluid into the zone.

Embodiment 4: The method of Embodiment 3, wherein the injection tool is coupled to a drill pipe.

Embodiment 5: The method of Embodiment 3, further comprising: after flowing the mud into the wellbore such that the fluid pill is positioned in the zone of the wellbore, removing a drill pipe, and wherein positioning the injection tool in the zone comprises positioning the injection tool using a wireline.

Embodiment 6: The method of any one of Embodiments 1-5, wherein the particulate comprises particles having a diameter of at least 10 microns.

Embodiment 7: The method of any one of Embodiments 1-5, wherein the particulate comprises particles having a diameter of at least 40 microns.

Embodiment 8: The method of any one of Embodiments 1-5, wherein the particulate comprises particles having a diameter of at least 250 microns.

Embodiment 9: The method of any one of Embodiments 1-8, further comprising: introducing at least one additional fluid pill into the mud flow into the wellbore, wherein at least one additional fluid pill has a different injection fluid with an injection composition that is different from the injection composition of the fluid pill and the mud composition, wherein the particulate has been added to the injection fluid to increase the weight of the at least one additional fluid pill to be in the defined range; after flowing the mud into the wellbore such that the at least one additional fluid pill is positioned in the zone of the wellbore, performing the following, filtering out the particulate from the different injection fluid; injecting the different injection fluid into the zone; measuring the downhole parameter that changes in response to injecting the different injection fluid into the zone, and determining the property of the surrounding subsurface formation of the zone based the measured downhole parameter that changes in response to injecting the different injection fluid into the zone.

Embodiment 10: A system comprising: a test string to be positioned in a wellbore; a pump to pump a mud down the wellbore, the mud having a mud composition and having a weight in a defined range, wherein a fluid pill has been introduced into the mud prior to being pumped down the wellbore, wherein the fluid pill comprises an injection fluid with an injection composition that is different from the mud composition, wherein a particulate has been added to the injection fluid to increase the weight of the fluid pill to be in the defined range for the weight of the mud composition; and a downhole tool coupled to a distal end of the test string, wherein the downhole tool is to be positioned at a depth of the wellbore that is within a zone of a surrounding subsurface formation, wherein the downhole tool is to, receive the fluid pill in the mud; filter out the particulate from the injection fluid; inject, after filtering, the injection fluid into the zone; measure a downhole parameter that changes in response to injection of the injection fluid into the zone; and determine a property of the surrounding subsurface formation of the zone based on the measured downhole parameter that changes in response to injecting the injection fluid into the zone.

Embodiment 11: The system of Embodiment 10, wherein the test string comprises at least one of drill pipe, tubing, and downhole fluid conduit.

Embodiment 12: The system of Embodiment 10, further comprising a drill pipe to be positioned in the wellbore, wherein the pump is to pump the mud down the wellbore through the drill pipe such that the fluid pill is positioned in the zone.

Embodiment 13: The system of Embodiment 12, wherein the drill pipe is to be removed from the wellbore after the fluid pill is positioned in the zone, wherein the downhole tool is to be positioned at the depth in the wellbore that is within the zone using a wireline.

Embodiment 14: The system of any one of Embodiments 10-13, wherein the particulate comprises particles having a diameter of at least 10 microns.

Embodiment 15: The system of any one of Embodiments 10-13, wherein the particulate comprises particles having a diameter of at least 40 microns.

Embodiment 16: The system of any one of Embodiments 10-13, wherein the particulate comprises particles having a diameter of at least 250 microns.

Embodiment 17: One or more non-transitory machine-readable media comprising program code executable by at least one processor to cause the at least one processor to: control a pump to flow a mud into a wellbore, the mud having a mud composition and having a weight in a defined range; control introduction of a fluid pill into the mud flowing into the wellbore, the fluid pill having an injection fluid with an injection composition that is different from the mud composition, wherein a particulate has been added to the injection fluid to increase the weight of the fluid pill to be in the defined range, wherein the particulate is to be filtered from the injection fluid after the fluid pill is positioned at a depth in the wellbore that includes a zone of a surrounding subsurface formation, wherein, after the particulate is filtered from the injection fluid, the injection fluid is to be injected into the zone, wherein a downhole parameter is to be measured that changes in response to the injection of the injection fluid into the zone; and determine a property of the surrounding subsurface formation of the zone based on the measured downhole parameter that changes in response to injecting the injection fluid into the zone.

Embodiment 18: The one or more non-transitory machine-readable media of Embodiment 17, wherein an injection tool is to be positioned in the zone, wherein the injection tool has a filter, wherein the particulate is to be filtered out from the injection fluid using the filter.

Embodiment 19: The one or more non-transitory machine-readable media of any one of Embodiments 17-18, wherein the particulate comprises particles having a diameter of at least 10 microns.

Embodiment 20: The one or more non-transitory machine-readable media of any one of Embodiments 17-18, wherein the particulate comprises particles having a diameter of at least 40 microns.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A method comprising:

flowing a mud into a wellbore, the mud having a mud composition and having a weight in a defined range;

introducing a fluid pill into the mud flowing into the wellbore, the fluid pill having an injection fluid with an injection composition that is different from the mud composition, wherein a particulate has been added to the injection fluid to increase the weight of the fluid pill to be in the defined range; and after flowing the mud into the wellbore such that the fluid pill is positioned at a depth in the wellbore that includes a zone of a surrounding subsurface formation, performing the following, filtering out the particulate from the injection fluid downhole in the wellbore;

injecting, after the filtering, the injection fluid into the zone;

measuring a downhole parameter that changes in response to injecting the injection fluid into the zone; and determining a property of the surrounding subsurface formation of the zone based on the measured downhole parameter that changes in response to injecting the injection fluid into the zone.

2. The method of claim 1, wherein the particulate comprises particles having a diameter of at least 10 microns.

3. The method of claim 1, wherein the particulate comprises particles having a diameter of at least 40 microns.

4. The method of claim 1, wherein the particulate comprises particles having a diameter of at least 250 microns.

5. The method of claim 1, further comprising:

introducing at least one additional fluid pill into the mud flow into the wellbore, wherein the at least one additional fluid pill has a different injection fluid with an injection composition that is different from the injection composition of the fluid pill and the mud composition, wherein the particulate has been added to the injection fluid to increase the weight of the at least one additional fluid pill to be in the defined range;

after flowing the mud into the wellbore such that the at least one additional fluid pill is positioned in the zone of the wellbore, performing the following, filtering out the particulate from the different injection fluid;

injecting the different injection fluid into the zone;

measuring the downhole parameter that changes in response to injecting the different injection fluid into the zone, and determining the property of the surrounding subsurface formation of the zone based the measured downhole parameter that changes in response to injecting the different injection fluid into the zone.

6. The method of claim 1, further comprising:

positioning an injection tool in the zone, the injection tool having a filter, wherein filtering out the particulate comprises filtering out the particulate from the injection fluid using the filter.

7. The method of claim 6, wherein injecting comprises injecting, using the injection tool, the injection fluid into the zone.

8. The method of claim 7, wherein the injection tool is coupled to a drill pipe.

9. The method of claim 7, further comprising:

after flowing the mud into the wellbore such that the fluid pill is positioned in the zone of the wellbore, removing a drill pipe, and wherein positioning the injection tool in the zone comprises positioning the injection tool using a wireline.

10. A system comprising:

a test string to be positioned in a wellbore;

a pump to pump a mud down the wellbore, the mud having a mud composition and having a weight in a defined range, wherein a fluid pill has been introduced into the mud prior to being pumped down the wellbore, wherein the fluid pill comprises an injection fluid with an injection composition that is different from the mud composition, wherein a particulate has been added to the injection fluid to increase the weight of the fluid pill to be in the defined range for the weight of the mud composition; and a downhole tool coupled to a distal end of the test string, wherein the downhole tool is to be positioned at a depth of the wellbore that is within a zone of a surrounding subsurface formation, wherein the downhole tool is to, receive the fluid pill in the mud;

filter out the particulate from the injection fluid;

inject, after filtering, the injection fluid into the zone;

measure a downhole parameter that changes in response to injection of the injection fluid into the zone; and determine a property of the surrounding subsurface formation of the zone based on the measured downhole parameter that changes in response to injecting the injection fluid into the zone.

11. The system of claim 10, wherein the test string comprises at least one of drill pipe, tubing, and downhole fluid conduit.

12. The system of claim 10, wherein the particulate comprises particles having a diameter of at least 10 microns.

13. The system of claim 10, wherein the particulate comprises particles having a diameter of at least 40 microns.

14. The system of claim 10, wherein the particulate comprises particles having a diameter of at least 250 microns.

15. The system of claim 10, further comprising a drill pipe to be positioned in the wellbore, wherein the pump is to pump the mud down the wellbore through the drill pipe such that the fluid pill is positioned in the zone.

16. The system of claim 15, wherein the drill pipe is to be removed from the wellbore after the fluid pill is positioned in the zone, wherein the downhole tool is to be positioned at the depth in the wellbore that is within the zone using a wireline.

17. One or more non-transitory machine-readable media comprising program code executable by at least one processor to cause the at least one processor to:

control a pump to flow a mud into a wellbore, the mud having a mud composition and having a weight in a defined range;

control introduction of a fluid pill into the mud flowing into the wellbore, the fluid pill having an injection fluid with an injection composition that is different from the mud composition, wherein a particulate has been added to the injection fluid to increase the weight of the fluid pill to be in the defined range, wherein the particulate is to be filtered from the injection fluid after the fluid pill is positioned at a depth in the wellbore that includes a zone of a surrounding subsurface formation, wherein, after the particulate is filtered from the injection fluid, the injection fluid is to be injected into the zone, wherein a downhole parameter is to be measured that changes in response to the injection of the injection fluid into the zone; and determine a property of the surrounding subsurface formation of the zone based on the measured downhole parameter that changes in response to injecting the injection fluid into the zone.

18. The one or more non-transitory machine-readable media of claim 17, wherein an injection tool is to be positioned in the zone, wherein the injection tool has a filter, wherein the particulate is to be filtered out from the injection fluid using the filter.

19. The one or more non-transitory machine-readable media of claim 17, wherein the particulate comprises particles having a diameter of at least 10 microns.

20. The one or more non-transitory machine-readable media of claim 17, wherein the particulate comprises particles having a diameter of at least 40 microns.

* * * * *